United States Patent [19]

Wang

[11] Patent Number: 4,840,680

[45] Date of Patent: Jun. 20, 1989

[54] METHOD FOR DEGREASING A COLD ROLLED METALLIC BAND

[75] Inventor: Robert Wang, Wissous, France

[73] Assignee: Societe Stein Heurtey, Z.A.I., Ris Orangis, France

[21] Appl. No.: 48,468

[22] Filed: May 8, 1987

Related U.S. Application Data

[63] Continuation-in-part of Ser. No. 720,600, Apr. 5, 1985, abandoned.

[30] Foreign Application Priority Data

Sep. 28, 1984 [FR] France ..... 84 14950
Apr. 5, 1985 [FR] France ..... 84 05366

[51] Int. Cl.[4] ..... B08B 5/00; C23G 5/00

[52] U.S. Cl. ..... 134/40; 134/19; 148/20.3

[58] Field of Search ..... 134/19, 40; 148/13, 148/13.1, 20.3

[56] References Cited

U.S. PATENT DOCUMENTS

| | | | |
|---|---|---|---|
| 2,189,836 | 2/1940 | Sehon | 148/13.1 X |
| 2,506,364 | 5/1950 | Jarvie et al. | 148/13.1 X |
| 3,061,485 | 10/1962 | Robinson | 148/13.1 |
| 3,627,289 | 12/1971 | Erman | 134/19 |

*Primary Examiner*—Arthur L. Corbin
*Attorney, Agent, or Firm*—Wenderoth, Lind & Ponack

[57] ABSTRACT

A method of degreasing a cold rolled metallic band, through the chemical effect of an atmosphere of a determined composition, according to which the heating and degreasing actions are separated, wherein the heating is carried out in an enclosure provided with means for applying heat by radiation, and the degreasing is obtained by the chemical effect of said atmosphere in the heating enclosure, said method being characterized in that said atmosphere is made of a mixture of nitrogen and hydrogen enriched with steam injected in the degreasing section of said enclosure.

7 Claims, 1 Drawing Sheet

METHOD FOR DEGREASING A COLD ROLLED METALLIC BAND

This application is a continuation-in-part of application Ser. No. 720,600, filed Apr. 5, 1985, now abandoned.

BACKGROUND OF THE INVENTION

The present invention relates to a method for degreasing a cold rolled metallic band, and more particularly a band treated continuously, preferably a ferrous band, or a copper band.

This invention is an improvement to that disclosed and claimed in USA patent application No. 389,153 dated June 16, 1983, now abandoned, by the present applicant. In this prior patent application is disclosed a degreasing method of a cold rolled metallic band in which the heating and degreasing actions are separated:

(a) the heating is carried out in an enclosure provided with means for bringing heat by radiation, notably electrical; and (b) the degreasing is obtained through the effect of an appropriate atmosphere in the heating enclosure.

In this prior patent application, the atmosphere used is made of a mixture of $N_2$, $H_2$, $H_2O$, $CO_2$ and CO, and it results from the sub-stoichiometric combustion of a fossil fuel (gas or oil). The total degreasing of the metallic band is therefore obtained by the heating and cracking of the oils, by the chemical action of the gases of the atmosphere of the fumes resulting from the combustion of said fossil fuel.

Therefore, the atmosphere having the aforementioned composition in the prior patent application includes reducing gases ($H_2$ and CO), and also oxidizing gases ($H_2O$ and $CO_2$).

SUMMARY OF THE INVENTION

The applicant has established that an $N_2$—$H_2$—$H_2O$ mixture, comprising a single reducing gas and a single oxidizing gas, of a particular composition, provided the same effects as a mixture with two components of each nature.

Consequently, the present invention relates to a method of degreasing a cold rolled metallic band through the chemical effect of an atmosphere of a determined composition, to which the heating and degreasing actions are separated: the heating being carried out in an enclosure provided with means for providing heat by radiation, and the degreasing being obtained through the chemical effect of said atmosphere in the heating enclosure, said method being characterized in that said atmosphere is made of a hydrogen and nitrogen mixture enriched with steam injected in the degreasing section of said enclosure.

According to the invention, the hydrogen content of the mixture is between 2% and 30% and the steam content is between 5% and 30% of a complete $N_2$—$H_2$—$H_2O$ mixture injected in the degreasing section.

The other treatment conditions, specified in the prior patent application, remain unchanged.

According to a feature of this invention, the metallic band can be heated, by the heating means by radiation, to a temperature between 300° C. and 700° C. and preferably between 350° and 700° C., necessary for providing the degreasing by a chemical effect of the atmosphere.

In order to promote the chemical effect of the atmosphere, the injected gaseous mixture can be pre-heated to a temperature of the order of 700° C., by any appropriate means.

According to the invention, for avoiding any condensation of the steam in the degreasing enclosure, the steam of the atmosphere can be injected in an $N_2$, $H_2$ stream (a mixture of nitrogen and hydrogen) already pre-heated.

When reading the hereabove description, one sees that this invention provides a method which is simpler with respect to the method disclosed in the US application No. 389,153, the replacement of the combustion gases, made of $N_2$, $H_2$, CO, $CO_2$ and $H_2O$, by a mixture of $N_2$, $H_2$ and steam, injected at the same rate as in the prior method, or even in the lowest temperature region, allowing obtaining the same oxidization potential with respect to the band as the fumes of the prior patent application atmosphere.

According to a variant of this invention, one can consider a different way for providing the degreasing atmosphere.

According to said variant, the atmosphere is provided by injection of air in a quantity such that the combination of the oxygen contained in the air with the hydrogen present in said atmosphere provides the same atmosphere gas final composition as if a nitrogen, hydrogen and steam mixture was directly injected, as hereabove described.

It will be appreciated that according to this variant, the air injected provides the nitrogen of the atmosphere final composition, and the steam necessary for this final atmosphere results from the combustion of part of the atmosphere hydrogen in the presence of the oxygen of the air.

The other treatment conditions hereabove specified remain unchanged.

According to another feature of this variant, the degreasing atmosphere is provided by an injection of air, as hereabove mentioned, combined with an injection of fumes resulting from the combustion of a gaseous fuel, whereby said combustion can be carried out either inside or outside the enclosure where the degreasing is effected. The combustion of the gaseous fuel is preferably a sub-stoichiometric combustion, in a pre-mixture or not, with a rate of unburnt residues bwetween 0.5 and 10%.

This variant provides a simplification of the procedure relative to the hereabove described method, while authorizing the same oxidization potential with respect to the band, since the final composition of the degreasing atmosphere remains the same.

DESCRIPTION OF THE PREFERRED EMBODIMENT

An explanation will now be made in respect to the actual workings of the present invention with reference to the drawings.

Firstly, it should be pointed out that although this method is a method for degreasing metallic bands (steel or copper), the main application of this process is directed toward the cleaning of steel bands and, more particularly, the preparation of a surface prior to galvanization.

During the cold rolling process, rolling oils are imparted to the steel bands. Such oils must be removed prior to the galvanizing step, otherwise the steel will not be properly coated or galvanized during the galvanizing step. The present process offers a simple and expeditious way of achieving this in a continuous process.

The present process is a continuous process applied to a band which is uncoiling itself within an enclosure provided with means for heating by radiation. The heating may be effected either by electrical means, such as bare resistors or heater plugs, or by means of tubes traversed by fumes derived from combustion, also referred to as radiation tubes.

Figure 1:
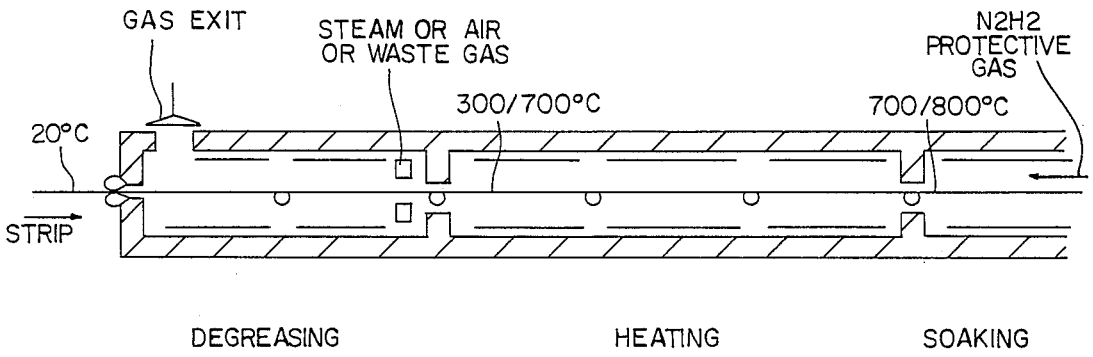
FIG. 1 shows the configuration of an enclosure or furnace designed to carry out the process.

In the diagram of FIG. 1, the metal band passes through the furnace from the left-hand to the right-hand portion, while the gases move from the right-hand to the left-hand portion.

This enclosure is traversed by a stream of circulating gas composed of a mixture of nitrogen and hydrogen. There is injected into the stream of this gas at the indicated site a (gaseous) composition that ensures directly or indirectly (by means of the reaction with the hydrogen of the circulating gas) the presence of the water vapor in the portions of 5 to 30 percent as discussed above.

The heating means shown in the enclosure in FIG. 1 are electrical resistors, but needless to say, they may be replaced by radiation tubes heated internally by the combustion of fossil fuel.

The degreasing itself under the effects of a gaseous atmosphere on the band is not a novel process. Such process as the so-called SENDZMIP process or modified SENDZMIR process, known as the NON-OX process employ such chemical degreasing procedures by a gaseous atmosphere. The temperatures used in such processes are higher (by above 1000° C. and usually between 1300–1350° C.) than that employed herein in which the temperature in the enclosure are below 1000° C.

The physico-chemical mechanism on which the effectiveness of the degreasing according to our invention is based consists in evaporating the lamination residues and in breaking down these residues in the presence of water vapor according to a disintegration which leads only to light hydrocarbons entrained by the gases traversing the enclosure and eliminated outside the furnace.

In the course of laboratory tests and industrial tests, it has been discovered that the presence of a quantity of water vapor greater than the minimum indicated (i.e., usually used) was absolutely indispensable for the proper functioning of the process. Indeed, below 5 percent of water vapor, it was not possible to detect the cracking of lamination oils, that is to say, their disintegration with the appearance of free carbon which is deposited both on the walls of the enclosure and the possibility, under certain conditions, that this free carbon is also deposited on the band itself, preventing its further galvanization.

Further, according to the present process which employs a mixture of nitrogen and hydrogen enriched with water steam, the absence of oxygen guarantees the non-oxidation of the steel band traversing the furnace. In certain cases, there is introduced into the enclosure a gas which is enriched with oxygen, but this gas combines immediately with the circulating gas, thereby producing the water vapor sought after for the effectiveness of the process.

Hence, the present process relates to an atmosphere that does not give rise to oxidation of the band, due to the absence of oxygen, but also because this is a continuous treatment, the duration of the degreasing phase is usually under one minute. Within this period, the oxidizing action of the water vapor is negligible in the case where $CO_2$ is introduced as in variant No. 2, which will subsequently be discussed.

It must be emphasized that the continuous treatment of a metal band represents quite a different process than the treatment of stationary coils, for example.

That is, the treatment of coils is a long treatment (timewise) because of the composition of the coil with its successive turns of sheet metal. The treatment capacities are around one ton per hour.

On the other hand, the treatment of continuous bands, because of their movement within an enclosure, leads to considerably higher hourly capacities, usually between 10 and 100 tons per hour. Because of this, the treated surface is considerably larger in a continuous process than in a process carried out under a "bell", and the weight of the grease to be eliminated is also much heavier.

The evaporation and disintegration actions of hydrocarbons must be made within a very short period of time in a continuous process and, furthermore, they must be applied to much larger quantities of grease. To achieve this application introduces much larger quantities of water vapor, to cause the grease to decompose. This degreasing action comprises a grease-evaporating phase (which calls for the heating of the metal band) and a vapor-decomposing phase in which the grease-vapor is decomposed.

The presence of water vapor during this second phase enables the greases to decompose into clean gas., i.e., without free carbon (soot).

The two phases described above takes place in the degreasing section (or enclosure).

In connection with the reference to the separation of the heating and degreasing actions, this refers not to a physical separation, but rather a separation of the heating means (means for heating by radiation) from those permitting the degreasing action (chemical effect of the atmospheric gases).

This concept is derived from a comparison with the prior art processes in which the smokes produced by the burners supply simultaneously the heat enabling the metal band to be heated and the chemical atmosphere for the degreasing.

As can be seen from FIG. 1, the metal strip enters the degreasing enclosure at room temperature, is heated up in the enclosure with heating coils to a temperature of about 300–700° C. from room temperature, and preferably within the range of 350–700° C. At this stage the grease evaporates and the grease components are chemcially decomposed by the $H_2$, $N_2$ gaseous and steam atmosphere injected in the furnace at the various sites designated in FIG. 1.

An example for carrying out the method according to this variant is given hereafter. The accompanying diagram shows the steps of the method thus implemented.

Figure 2:
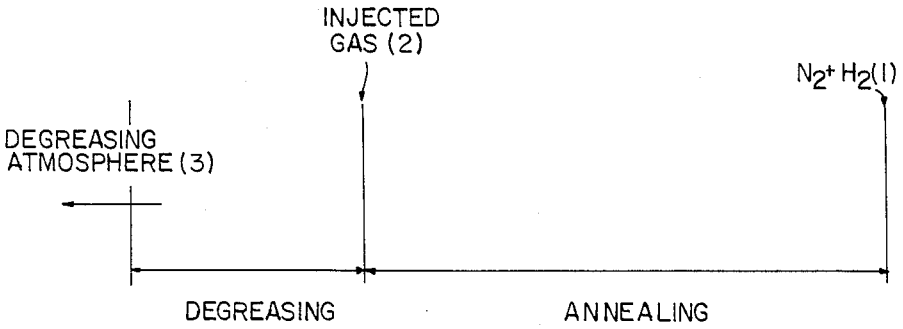
FIG. 2 also represents a diagram depicting the general operations which take place in a furnace designed to carry out the process of the present invention.

In the typical application conditions of the method, a flow rate of the $N_2 + H_2$ mixture of 150 $Nm^3/h$ is injected in the vicinity of the metallization bath as shown in FIG. 2. This flow rate flows through the cooling and annealing sections and reaches the degreasing section. In this degreasing section, as described in FIG. 2, is injected a flow rate of air of 35 $Nm^3/h$. The oxygen of the air combines with the hydrogen contained in said scavenging gas, and the resulting atmosphere contains 4.4% of $H_2$, 8.3% of $H_2O$, the remaining being nitrogen.

The total flow rate of said atmosphere being of 178 $Nm^3/h$, said operation is equivalent to the injection, in the pre-heating section, of 361 $Nm^3/h$ of a mixture containing 11.7% of $H_2O$ and 88.3% of $N_2$.

The following Table sums up the operation conditions (Case 1 and Case 2).

According to another alternative of said invention, the atmosphere is provided by the injection of the oxidizing fumes according to a quantity such that the oxygen in excess contained in the fumes combines with the hydrogen present in the atmosphere in order to produce steam which adds up to the steam already present in the injected fumes. The degreasing atmosphere thus provided contains hydrogen, steam, and a small quantity of $CO_2$ introduced with the fumes. The operation conditions are summed up in the Table (Case 3).

TABLE

| Gas | | Flow rate | % $O_2$ | % $H_2$ | % $H_2O$ | % $N_2$ |
|---|---|---|---|---|---|---|
| Gas (1) | Case 1 | 150 $Nm^3/h$ | 0 | 15 | 0 | 85 |
| Gas (2) | | 35 | 21 | 0 | 0 | 79 |
| Gas (3) | | 177.7 | 0 | 4.4 | 8.3 | 87.3 |
| Gas (1) | Case 2 | 150 $Nm^3/h$ | 0 | 15 | 0 | 85 |
| Gas (2) | | 361 | 0 | 0 | 11.7 | 88.3 |
| Gas (3) | | 511 | 0 | 4.4 | 8.3 | 87.3 |
| Gas (1) | Case 3 | 150 $Nm^3/h$ | 0 | 15 | 0 | 85 |
| Gas (2) | | 148 | 3.2 | 0 | 15.8 | 72.9 |
| Gas (3) | | 293 | 0 | 4.4 | 11.3 | 80.3 |

What I claim is:

1. A method of continuously removing grease from a cold rolled metallic band by the chemical effects of an atmosphere of a specific composition, which consists essentially of heating the grease-containing cold rolled metallic band at a temperature of between 350° C. and 700° C. in an enclosure provided with means for heating the grease-containing cold rolled metallic band and vaporizing the grease from the metallic band, and contacting the grease vapors with a gaseous atmosphere introduced into the enclosure, which gaseous atmosphere chemically decomposes the grease by a reaction between the gaseous atmosphere and the vaporized grease, said gaseous atmosphere consisting essentially of a mixture of nitrogen and hydrogen enriched with water in the form of steam, said hydrogen being present in an amount of 2 to 30 percent and the steam being present in an amount of 5 to 30 percent based on the complete gaseous mixture.

2. A method according to claim 1, wherein the gaseous mixture introduced in the enclosure is subjected to a pre-heating up to a temperature of the order of 700° C.

3. A method according to claim 2, wherein the steam necessary for the degreasing atmosphere is injected in a stream of a nitrogen and hydrogen gaseous mixture, which has been preheated up to a temperature of 700° C.

4. A method according to claim 1, wherein the degreasing atmosphere is obtained by an injection of air into an atmosphere of nitrogen and hydrogen gas in said enclosure, such that the combination of the oxygen contained in the air with the hydrogen present in the atmosphere of nitrogen and hydrogen gas gives the degreasing atmosphere a final composition as if a nitrogen, hydrogen and steam mixture was directly injected into said enclosure.

5. A method according to claim 4, wherein there is further injected, in the degreasing atmosphere, fumes resulting from the combustion of a gaseous fuel.

6. A method according to claim 5, wherein there is used a sub-stoichiometric combustion of the gaseous fuel at such a rate that the unburnt residues in the gaseous fuel is between 0.5 and 10%.

7. A method according to claim 1, wherein the degreasing atmosphere is obtained by the injection of oxidizing fumes containing oxygen, water and a small amount of $CO_2$ into a hydrogen-nitrogen atmosphere in the enclosure, such that the oxygen contained in the fumes reacts with the hydrogen to produce water in the form of steam and such that the degreasing atmosphere contains hydrogen, steam and nitrogen and a small quantity of $CO_2$ introduced with the oxidizing fumes.

* * * * *